United States Patent [19]

Perotto

[11] Patent Number: 4,963,202

[45] Date of Patent: Oct. 16, 1990

[54] PROCESS FOR THE MANUFACTURE OF CHARGES OF A SOLID COMPOSITION GENERATING NONTOXIC GASES AND CHARGES THUS OBTAINED

[75] Inventor: Christian Perotto, Ballancourt, France

[73] Assignee: S.N.C. Livbag, Bouchet, France

[21] Appl. No.: 504,258

[22] Filed: Apr. 4, 1990

[30] Foreign Application Priority Data

Apr. 17, 1989 [FR] France ..... 89 05032

[51] Int. Cl.[5] ..... G06B 35/00

[52] U.S. Cl. ..... 149/35; 149/109.2; 149/109.6

[58] Field of Search ..... 149/35, 109.6, 109.2

[56] References Cited

U.S. PATENT DOCUMENTS 4,243,443 1/1981 Utracki ..... 149/35

*Primary Examiner*—Stephen J. Lechert, Jr.

*Attorney, Agent, or Firm*—Bucknam and Archer

[57] ABSTRACT

The present invention relates to a process for the manufacture of charges for generators of nontoxic cold gases based on alkali metal or alkaline-earth metal azide, molybdenum sulphide and sulphur.

After being formed, the charges are heated to a temperature of between 120° C. and 130° C. for 5 to 20 minutes.

After cooling, the charges thus treated exhibit mechanical properties which are greatly superior to those of the charges of identical nature which have not undergone the heat treatment according to the invention.

The charges according to the invention find their preferred application in gas generators intended for motor car safety.

10 Claims, No Drawings

PROCESS FOR THE MANUFACTURE OF CHARGES OF A SOLID COMPOSITION GENERATING NONTOXIC GASES AND CHARGES THUS OBTAINED

The present invention relates to pyrotechnic generators of nontoxic cold gases. More precisely, the invention relates to a new process for the manufacture of pyrotechnic charges producing nontoxic cold gases and to the charges obtained which can be employed as a charge in a gas generator of this kind, especially in a gas generator intended to deploy an inflatable safety cushion installed in motor vehicles.

It is known to provide the passengers in a motor vehicle with protection against impact by virtue of cushions which inflate at the time of the impact under the effect of gas originating from a pyrotechnic gas generator initiated by an impact detector. The generation of the gases is produced by combustion, in the said generator, of a solid composition generating gases which are cooled and filtered before entering the said cushion.

To ensure a satisfactory operation of the gas generator, the solid composition which is generally in the form of pellets or small blocks must satisfy a number of essential requirements:

(a) it must have a very high combustion rate, so as to ensure the inflation of the cushion in periods of time of a few tens of milliseconds without, however, being explosive, (b) it must generate so-called "cold" gases so that, after quickly passing through the cooling device of the generator, these gases enter the cushion at a temperature which can be tolerated by the passenger's body. It is generally accepted that these "cold" gases must have a combustion temperature which must not exceed 500° C.-600° C., c) it must generate gases which are nontoxic to the passengers, d) lastly, to avoid any undue fire risk, it must generate inert gases.

For these last two reasons, compositions which generate nitrogen are particularly sought after. Among the nitrogen-generating compositions, solid compositions based on alkali metal or alkaline-earth metal azide and metal sulphides such as molybdenum sulphide, optionally in the presence of sulphur, have been found to satisfy the first two requirements particularly well, namely the high combustion rate and a moderate combustion temperature. Such compositions are, for example, described in U.S. Pat. Nos. 3,741,585, 4,203,787, 4,547,235 and 4,734,141. These compositions are perfectly satisfactory from the viewpoint of the generation of nontoxic cold gases but they have the disadvantage of not having good mechnical properties when put in the form of compact charges. Now, the charges thus produced are called upon to be capable of being stored for a number of years in a motor vehicle subjected to many mechanical stresses without deteriorating.

The aim of the present invention is precisely to improve the mechanical properties of the charges produced from the compositions referred to above, so as to guarantee a good mechanical conservation of these charges with time once they are subjected to mechanical stresses such as vibrations, repeated accelerations, especially when they are distributed inside a motor vehicle.

The invention relates, therefore, to a process for the manufacture of charges for gas generators intended especially for motor car safety from solid compositions generating nontoxic gases, whose constituents comprise at least (i) an alkali metal or alkaline-earth metal azide, (ii) a metal sulphide chosen from the group consisting of molybdenum sulphide or mixed molybdenum sulphides, and (iii) sulphur, by mixing the said constituents and compression-forming, characterized in that, after being formed, the said charges are heated to a temperature equal to at least 120° C. for a period equal to at least 5 minutes.

According to a first preferred alternative form of embodiment of the invention, the said charges are heated to a temperature of between 120° C. and 130° C. for a period of between 5 minutes and 20 minutes.

According to a second preferred alternative form of embodiment of the invention, the said charges are heated to a temperature of between 120° C. and 125° C. for a period of between 10 minutes and 15 minutes.

According to another preferred alternative form of embodiment of the invention, the weight content of sulphur in the said compositions is between 2% and 9%.

The invention also relates, as new products, to charges of a solid composition generating nontoxic gases, obtained by the process according to the invention.

A detailed description of the invention and of its potential uses is given below.

The invention relates, therefore, essentially to a process for the manufacture of charges for gas generators intended especially for motor vehicle safety. There exist traditionally two types of charges for generators of cold gases intended to permit the inflation of safety cushions for a motor vehicle.

The first type comprises charges, generally in the form of a cylindrical or annular block, which are placed inside the combustion chamber of the gas generator. In this case the charge may consist of a single component or of a number of elementary components whose juxtaposition forms the charge.

The second type comprises the charges consisting of a stack of pellets inside the combustion chamber of the gas generator.

As used in the present invention, the expression "charges for gas generators" is intended to mean the constituent elements of the generator charge, be they pellets, elementary components making it possible to constitute the cylindrical or annular block or the block itself, when it is a single component.

These charges are obtained by mixing, by a dry route or a wet route, the constituents of a solid composition generating nontoxic gases and by forming the mixture thus made up. This forming is generally carried out by compression. It may involve a compression in a press in the case where the charge forms a block or an elementary component of a block, or of a compression into pellets when the charge is in the form of a pellet.

The solid compositions generating nontoxic cold gases which can be employed within the scope of the present invention are compositions whose constituents comprise at least: (i) an alkali metal or alkaline-earth metal azide, (ii) a metal sulphide chosen from the group consisting of molybdenum sulphide and mixed molybdenum sulphides, and (iii) sulphur.

According to a preferred embodiment of the invention, the weight content of sulphur in the said composition is between 2% and 9% of the total weight of the said composition.

Sodium azide will be preferred as an azide within the scope of the present invention.

The mixed molybdenum sulphides employed may be advantageously mixed molybdenum and copper or iron sulphides and especially those corresponding to the formula $Mo_xM_yS_z$ in which:

Mo denotes a molybdenum atom,

M denotes an iron or copper atom,

S denotes a sulphur atom, x denotes an index with a value of between 0.7 and 3.0, y denotes an index with a value of between 1.0 and 5.0, z denotes an index with a value of between 4.0 and 12.0.

In addition to the constituents indicated above, whose presence is obligatory, the compositions according to the invention may contain other additives and especially inorganic nitrates such as potassium nitrate, or oxides such as iron, cobalt, nickel, palladium or silicon oxides. These additives then form part of the composition and should be taken into account in the total weight of the composition when reference is made to the weight contents indicated in the present application.

Nevertheless, the preferred compositions within the scope of the present invention are the compositions consisting of an alkali metal or alkaline-earth metal azide, of molybdenum sulphide and of sulphur, and particularly those based on sodium azide, molybdenum sulphide and sulphur. Among these latter compositions preference will be given to those in which the weight content of sodium azide is between 60% and 82%, the weight content of molybdenum sulphide between 15% and 35% and the weight content of sulphur between 2% and 9%.

As already said, the charges for gas generators are generally obtained by mixing the constituents of the said compositions in a solid mixer and by compression-forming the said mixture. The compression is generally carried out at room temperature at an average pressure of 4000 bars, that is 400 MPa, if the compression is carried out in a press, and 2000 bars, that is 200 MPa, if the compression is carried out in a pelletizer.

In a way which is characteristic within the scope of the present invention, after forming, the said charges are heated to a temperature equal to at least 120° C. for a period equal to at least 5 minutes. The heating takes place in a dry atmosphere, in general in an oven.

The Applicant Company has noted, furthermore, that, in the case of the usual charges, the best results are obtained when the said charges are heated to a temperature of between 120° C. and 130° C. for a period of between 5 minutes and 20 minutes.

The usual charges such as pellets or components approximately one centimeter in thickness will be preferably heated to a temperature of between 120° C. and 125° C. for a period of between 10 and 15 minutes.

After being heated, the charges are cooled to room temperature in the open air. In these conditions, it has been discovered that, when they are compared with identical charges which have not undergone the heat treatment according to the invention, the charges treated by the process according to the invention exhibit a combustion rate which is approximately 20% higher and mechanical strength properties which are greatly superior and which can in some cases be three times higher.

Although it is not the intention of the Applicant Company to limit itself to considerations of a theoretical nature, it believes that the treatment according to the invention permits a fusion and a recrystallization of the sulphur, which starts acting as a binder in the charge, thus markedly improving its mechanical behaviour and its combustion rate.

The charges obtained by the process according to the invention thus constitute new products which make it possible to produce charges for cold gas generators. These cold gas generators can be suitable for many applications and in particular as cold gas generators intended for motor car safety. The charges according to the invention exhibit all the advantages of the traditional charges of the same type from the viewpoint of the combustion rate and of the nontoxicity of the gases, but exhibit a greatly superior mechanical behaviour when compared with the latter.

The charges made up from the charges according to the invention thus exhibit a better mechanical conservation with time when they are fitted inside a motor vehicle or more generally in a carrier subjected to vibrations.

The examples which follow illustrate various its scope.

EXAMPLES 1 to 3

Cubes with a side of one centimeter were produced by compression at room temperature, starting with the following three compositions, in which the percentages are expressed by weight:

| | $NaN_3$ | $MoS_2$ | S | Specific Gravity |
|---|---|---|---|---|
| Example 1 | 70% | 26% | 4% | 1.99 |
| Example 2 | 79% | 16% | 5% | 1.86 |
| Example 3 | 80% | 16% | 2% | 1.85 |

For each example, these cubes were divided into two batches:

batch A: no additional treatment batch B: heating to 120° C. in an oven for 10 minutes.

After cooling the cubes of batch B, the combustion rates and the mechanical properties of the cubes of each batch were compared. The combustion rates were measured in a pressure-measurement bomb at a pressure of bars, that is 7 MPa, and the mechanical properties in compression were measured with an Instron® trademark aparatus at 20° C., the compression plunger having a speed of 1 mm/min.

The results were as follows:

| | | Combustion rate |
|---|---|---|
| Example 1 | Batch A | 28 mm/s |
| | Batch B | 38 mm/s |
| Example 2 | Batch A | 28 mm/s |
| | Batch B | 32 mm/s |
| Example 3 | Batch A | 25 mm/s |
| | Batch B | 28 mm/s |

| | | Tensile strength | Elasticity modulus | Elasticity |
|---|---|---|---|---|
| Ex 1 | Batch A | 4.3 MPa | 119 MPa | 3.70% |
| | Batch B | 12.4 MPa | 299 MPa | 4.60% |
| Ex 2 | Batch A | 6.7 MPa | 326 MPa | 2.2% |
| | Batch B | 20.1 MPa | 758 MPa | 3.5% |
| Ex 3 | Batch A | 11.4 MPa | 460 MPa | 2.6% |
| | Batch B | 18.8 MPa | 646 MPa | 3.8% |

It is found that the samples which have undergone the heat treatment according to the invention exhibit an improved combustion rate and considerably superior mechanical properties when compared with the samples which have not undergone it.

EXAMPLES 4 to 10

Cylindrical pellets with parallel faces 8 mm in diameter and 3.4 mm in thickness were manufactured by pelleting from the following seven compositions:

| | $NaN_3$ | $MoS_2$ | S | Specific Gravity |
|---|---|---|---|---|
| Example 4 | 70% | 26% | 4% | 2.06 |
| Example 5 | 74% | 21% | 5% | 1.98 |
| Example 6 | 70% | 21.3% | 8.7% | 2.00 |
| Example 7 | 69% | 28% | 3% | 2.07 |
| Example 8 | 64.5% | 32.7% | 2.8% | 2.13 |
| Example 9 | 69% | 23% | 8% | 2.01 |
| Example 10 | 63.5% | 34.6% | 1.9% | 2.16 |

The sodium azide ($NaN_3$), molybdenum sulphide ($MoS_2$ and sulphur (S) contents are weight contents In the case of each example, the pellets were divided into two batches, one batch undergoing no heat treatment, another batch undergoing heating at 120° C. for minutes.

The tensile strengths were measured on an Erweka ® trademark apparatus for the pellets of the various batches. The results were as follows:

| | without heat treatment | with heat treatment |
|---|---|---|
| Example 4 | 1.9 kgf | >14 kgf |
| Example 5 | 4.6 kgf | >14 kgf |
| Example 6 | 4.2 kgf | >14 kgf |
| Example 7 | 3.7 kgf | =14 kgf |
| Example 8 | 1.7 kgf | 10 kgf |
| Example 9 | 2.6 kgf | >14 kgf |
| Example 10 | 1.9 kgf | 7 kgf |

These examples confirm the spectacular improvement in the mechanical properties of the pellets which have undergone the heat treatment according to the invention.

EXAMPLE 11

Using a composition identical with that of Example 4, cylindrical pellets with parallel faces 6.26 mm in diameter, 2.0 mm in thickness and with a density of 2.0 were manufactured by pelleting.

These pellets were divided into two batches, one batch undergoing no heat treatment, another batch undergoing heating at 120° C. for 10 minutes.

In the case of each batch of pellets, the combustion rate was measured in a pressure-measurement bomb at a pressure of 70 bars, that is 7 MPa, and the tensile strength under the same conditions as those of Examples 4 to 10.

The results were as follows:

| | without heat treatment | with heat treatment |
|---|---|---|
| Combustion rate | 11.0 mm/s | 13.0 mm/s |
| Tensile strength | 1.3 kgf | 8.0 kgf |

Examples 4 to 11 confirm, for the pellet geometry, the improvement in the results observed for the cube geometry in Examples 1 to 3.

I claim:

1. Process for the manufacture of charges for gas generators from solid compositions generating nontoxic gases, whose constituents comprise at least (i) an alkali metal or alkaline-earth metal azide, (ii) a metal sulphide chosen from the group consisting of molybdenum sulphide or mixed molybdenum sulphides, and (iii) sulphur, by mixing the said constituents and compression-forming, characterized in that, after being formed, the said charges are heated to a temperature equal to at least 120° C. for a period equal to at least 5 minutes.

2. Process according to claim 1, characterized in that the said charges are heated to a temperature of between 120° C. and 130° C.

3. Process according to claim 1, characterized in that the said charges are heated to a temperature of between 120° C. and 130° C. for a period of between 5 minutes and 20 minutes.

4. Process according to claim 1, characterized in that the said charges are heated to a temperature of between 120° C. and 125° C. for a period of between 10 minutes and 15 minutes.

5. Process according to claim 1, characterized in that the weight content of sulphur in the said composition is between 2% and 9%.

6. Process according to claim 1, characterized in that the said mixed molybdenum sulphides correspond to the formula $Mo_xM_yS_z$ in which:

Mo denotes molybdenum
M denotes copper or iron
S denotes sulphur
x has a value between 0.7 and 3.0
y has a value between 1.0 and 5.0
z has a value between 4.0 and 12.0.

7. Process according to claim 1, characterized in that the said solid compositions consist of an alkali metal or alkaline-earth metal azide, molybdenum sulphide and sulphur.

8. Process according to claim 7, characterized in that the said solid compositions consist of sodium azide, molybdenum sulphide and sulphur.

9. Process according to claim 8, characterized in that the weight content of sodium azide is between 60% and 82%, the weight content of molybdenum sulphide between 15% and 35%, the weight content of sulphur between 2% and 9%.

10. Charges of a solid composition generating nontoxic gases, obtained by the process according to claims 1 to 9.

* * * * *